US009371169B1

(12) United States Patent
Petrucci et al.

(10) Patent No.: US 9,371,169 B1
(45) Date of Patent: Jun. 21, 2016

(54) SYSTEMS, METHODS, AND APPARATUSES FOR SECURING CELL-BASED PRODUCTS FOR TRANSPORT IN THERMAL ISOLATION

(71) Applicant: Animal Cell Therapies, Inc., San Diego, CA (US)

(72) Inventors: Kathryn J. Petrucci, San Diego, CA (US); Jiunn-chern Yeh, San Diego, CA (US); Amanda Reilly, San Diego, CA (US)

(73) Assignee: ANIMAL CELL THERAPIES, INC., San Diego, CA (US)

( * ) Notice: Subject to any disclaimer, the term of this patent is extended or adjusted under 35 U.S.C. 154(b) by 0 days.

(21) Appl. No.: 14/725,950

(22) Filed: May 29, 2015

(51) Int. Cl.
*B65D 81/38* (2006.01)
*B65B 7/16* (2006.01)
*B65B 5/08* (2006.01)

(52) U.S. Cl.
CPC ..... *B65D 81/3832* (2013.01); *B65B 5/08* (2013.01); *B65B 7/16* (2013.01)

(58) Field of Classification Search
CPC ..... B65D 81/38; B65D 81/3813; F25D 3/08
USPC ..... 220/592.2, 592.23, 592.21, 592.22; 62/457.1, 457.2
See application file for complete search history.

(56) References Cited

U.S. PATENT DOCUMENTS 5,450,977 A * 9/1995 Moe ..... B65D 88/022 220/1.5
5,501,338 A * 3/1996 Preston ..... A45C 11/20 206/499
5,709,307 A * 1/1998 Rosado ..... A45C 11/20 150/901
5,897,017 A * 4/1999 Lantz ..... B65D 81/3823 220/592.1
5,924,302 A * 7/1999 Derifield ..... B65D 81/3862 62/371
6,044,650 A * 4/2000 Cook ..... A61J 1/165 62/130
2003/0102317 A1* 6/2003 Gordon ..... B65D 81/3823 220/592.2
2005/0224501 A1* 10/2005 Folkert ..... B65D 5/0236 220/592.2
2009/0078699 A1* 3/2009 Mustafa ..... B65D 81/3862 220/1.5

* cited by examiner

*Primary Examiner* — King M Chu
(74) *Attorney, Agent, or Firm* — Pillsbury Winthrop Shaw Pittman LLP

(57) ABSTRACT

Transport of containers for biologic products in secure thermal isolation may be facilitated by a containment apparatus. The containment apparatus may include a first component and a second component. The first component may comprise one or more sidewalls that may form an enclosed volume of the first component. The enclosed volume may be fluidly sealed from an environment surrounding the first component and at least partially filled with cooling media. The first component may comprise one or more recessed wells configured to receive at least part of individual containers. At least part of individual recessed wells may come into contact with cooling media within the enclosed volume to facilitate heat transfer between the cooling media and individual containers disposed in individual recessed wells.

13 Claims, 10 Drawing Sheets

SYSTEMS, METHODS, AND APPARATUSES FOR SECURING CELL-BASED PRODUCTS FOR TRANSPORT IN THERMAL ISOLATION

FIELD OF THE DISCLOSURE

This disclosure relates to securing biologic products for transport in thermal isolation.

BACKGROUND

Biologic products, such as cell-based products, vaccines, tissues, organs, blood, and other biologic products, are often shipped in containers by air, ground, and sea transport methods. Shipments may take hours or even days. It may be desired to maintain the products at target temperatures and/or within target temperature ranges during transport to ensure the viability of biologic products.

SUMMARY

One aspect of the disclosure relates to a system configured for securing biologic products for transport in thermal isolation. Biologic products may be stored in containers. A given container may include one or more of a vial, a bottle, a flask, a decanter, a vessel, an ampoule, a specimen container, a specimen jar, a vaccine type vial, a cryovial, a centrifuge tube, a micro-centrifuge tube, and/or other containers. In some implementations, one or more components of the system may include cooling media and/or other substances. The cooling media may be configured to cool and/or maintain a temperature of biologic products contained within one or more containers. The cooling media may be configured to change phases based on a temperature of the cooling media. By way of non-limiting example, the cooling media may include one or more of a gel, a liquid, a phase-change media, a refrigerant, and/or other cooling media.

In some implementations, the system may include one or more of a containment apparatus, a sleeve, and/or other components. The containment apparatus may be configured to secure one or more containers for biologic products for transport in thermal isolation. The containment apparatus may comprise one or more of a first component, a second component, and/or other components. The first component and second component may be configured to cooperatively engage in a closed position of the containment apparatus. The closed position may facilitate a securement of the one or more containers by the containment apparatus. One or more components of the system may be configured to maintain temperatures of secured biologic products in environments that may be substantially hotter than the desired transport temperatures of the biologic products.

The first component may comprise one or more sidewalls, one or more recessed wells, and/or other components. The one or more sidewalls may form an enclosed volume of the first component. The enclosed volume may be fluidly sealed from an environment surrounding the first component. The enclosed volume may be at least partially filled with cooling media.

Individual recessed wells may be configured to receive at least part of individual containers. Individual recessed wells may include one or more of an open end, a closed end opposite the open end, one or more well sidewalls running between the open end and closed end, and/or other components. The closed end may extend into the enclosed volume of the first component. In some implementations, at least part of individual recessed wells may come into contact with the cooling media disposed within the enclosed volume. The contact may facilitate heat transfer between the cooling media and individual containers disposed in individual recessed wells during securement of the containers by the containment apparatus.

The second component may comprise one or more second sidewalls, and/or other components. The one or more second sidewalls may form a second enclosed volume of the second component. The second enclosed volume may be fluidly sealed from an environment surrounding the second component. The second enclosed volume may be at least partially filled with a cooling media.

The sleeve may be configured to at least partially encompass the containment apparatus when in the closed position. The sleeve may comprise one or more insulated sidewalls, and/or other components. Individual insulated sidewalls may include an outer layer and an inner layer. The layers may form a second enclosed volume. The second enclosed volume may be fluidly sealed from an environment surrounding the sleeve. The second enclosed volume may be at least partially filled with cooling media.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
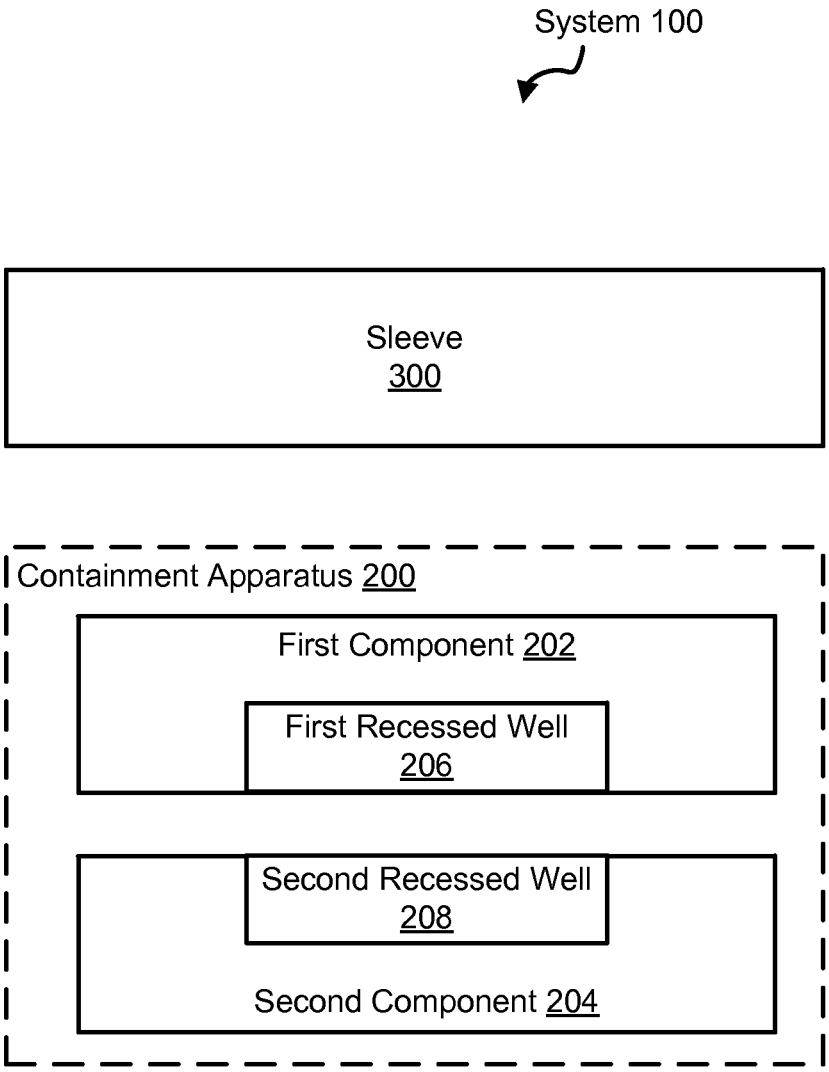
FIG. 1 illustrates a system configured for securing biologic products for transport in thermal isolation, in accordance with one or more implementations.

FIG. 1 illustrates a system 100 configured for securing biologic products for transport in thermal isolation, in accordance with one or more implementations. The system 100 may comprise one or more of a containment apparatus 200, a sleeve 300, and/or other components. In some implementations, containment apparatus 200 may be configured to secure one or more containers (not shown in FIG. 1) for biologic products for transport, storage, and/or other securement needs. By way of non-limiting example, a container for biologic products may include one or more of a vial, a bottle, a flask, a decanter, a vessel, an ampoule, a specimen container, a specimen jar, a vaccine type vial, a cryovial, a centrifuge tube, a micro-centrifuge tube, and/or other containers. Biologic products may include one or more of cell-based products, vaccines, tissues, organs, blood, and other biologic products. Biologic products may be animal based, plant based, human based, and/or other biologic products.

In some implementations, one or more of containment apparatus 200, sleeve 300, and/or other components of system 100 may include cooling media configured to cool and/or maintain a temperature of biologic products contained within one or more containers being secured by the containment apparatus 200. By way of non-limiting example, the cooling media may include one or more of a gel, liquid, a phase-change media, a refrigerant, and/or other cooling media.

The cooling media may be configured to maintain temperatures in the range of −30 to 30 degrees Celsius, and/or other range. The cooling media may be configured to maintain a desired temperature over a time period up to 72 hours, and/or for other time periods.

The cooling media may be configured to change phases based on a temperature of the cooling media. By way of non-limiting example, cooling media may be configured to be at first phase when at a first temperature and/or temperature range, a second phase when at a second temperature and/or temperature range, and/or other phases when at other temperatures and/or temperature ranges. By way of non-limiting example, a first phase may be gel when at the first temperature and/or temperature range. For example, the cooling media may be a gel in a first temperature range of 0 to 30 degrees Celsius and/or other ranges. A second phase may comprise a solid when at the second temperature and/or temperature range. For example, the cooling media may be configured to freeze to a solid phase in a second temperature range of −30 to 0 degrees Celsius and/or other ranges.

In some implementations, containment apparatus 200 may comprise one or more of a first component 202, a second component 204, and/or other components. The containment apparatus 200 may comprise one or more of a plastic polymer, polyethylene, polyvinyl chloride, metal, and/or other materials. The containment apparatus 200 may be formed by techniques such as blow molding, injection molding, and/or other techniques.

In some implementations, first component 202 may comprise one or more sidewalls, one or more recessed wells disposed on at least one of the one or more sidewalls, one or more registration components, one or more sleeve registration components, and/or other components. The one or more sidewalls of first component 202 may form a shape of first component 202. The shape may comprise one or more of a cube, a cuboid, a cylinder, and/or other shapes. Individual sidewalls may have a predefined thickness. By way of non-limiting example, individual sidewalls may be formed with a thickness in the range of one to five millimeters, and/or other ranges. By way of non-limiting example, individual sidewalls may be formed with a thickness of two millimeters, and/or other thicknesses.

In some implementations, one or more sidewalls of first component 202 may form an enclosed volume of first component 202. By way of non-limiting example, the one or more sidewalls of first component 202 may form a hollow, or substantially hollow, structure having the shape of first component 202. In some implementations, the enclosed volume of first component 202 may be fluidly sealed from an environment surrounding first component 202.

In some implementations, the enclosed volume formed by the one or more sidewalls of first component 202 may be at least partially filled with a cooling media and/or other substances. In some implementations, at least one of the one or more sidewalls of first component 202 may include a fluidly sealable fill port (not show in FIG. 1) and/or other components. The fluidly sealable fill port may provide access to the enclosed volume of first component 202 to facilitate introducing a desired amount of cooling media into and/or removing a desired amount of cooling media from the enclosed volume. By way of non-limiting example, the fluidly sealable fill port may comprise one or more of an aperture communicating through a sidewall of first component 202, a plug and/or other components configured to removably fluidly seal the aperture, and/or other components. In some implementations, a fluidly sealable fill port may be permanently sealed off once a desired amount of cooling media and/or other substances is provided in the enclosed volume.

In some implementations, first component 202 may comprise one or more recessed wells disposed in at least one of the one or more sidewalls, and/or other components. Individual recessed wells may be configured to receive at least part of individual containers for biologic products. Individual recessed wells may include one or more of an open end, a closed end opposite the open end, one or more well sidewalls running between the open end and the close end, and/or other components. Individual recessed wells of first component 202 may be sized in accordance with given biologic product containers that may be transported. For example, individual recessed wells may be sized in accordance with known geometries of biologic product containers. By way of non-limiting example, individual recessed wells may have a depth in the range of 10 to 100 millimeters and/or other ranges. By way of non-limiting example, a given recessed well of first component 202 may have a depth of 10 millimeters and/or other depth. Individual recessed wells of first component 202 may have a width in the range of 10 to 50 millimeters and/or other ranges. By way of non-limiting example, a given recessed well of first component 202 may have a width of 17 millimeters and/or other widths.

In some implementations, an open end of a given recessed well may be disposed at or near a plane of the at least one sidewall of first component 202 where the wells may be disposed. For example, an open end of a recessed well may be flush with at least one sidewall of first component 202.

In some implementations, a given recessed well of first component 202 may extend into the enclosed volume of first component 202 such that the closed end and/or at least part of the given one or more well sidewalls may come into contact with cooling media that may be disposed within the enclosed volume. A contact of a given recessed well with cooling media may facilitate heat transfer between the cooling media and a given container for biologic product that may be at least partially secured within the given recessed well. For example, at least part of a container may contact at least part of a well sidewall of a recessed well, while the well sidewall may be in contact with the cooling media within the enclosed volume of first component 202. The various contacts may facilitate heat transfer between cooling media, recessed well, and container secured within the recessed well. Heat transfer between cooling media, a recessed well, and a container may be accomplished in other ways.

In some implementations, second component 204 may comprise one or more second sidewalls, one or more second recessed wells disposed on at least one of the one or more second sidewalls, one or more second registration components, one or more second sleeve registration components, and/or other components. The one or more second sidewalls of second component 204 may form a second shape of second component 204. The second shape may comprise one or more of a cube, a cuboid, a cylinder, and/or other geometric shapes. Individual ones of the one or more second sidewalls may have a predefined thickness. By way of non-limiting example, individual second sidewalls may be formed having a thickness in the range of one to five millimeters, and/or other ranges. By way of non-limiting example, individual second sidewalls may be formed having a thickness of two millimeters, and/or other thicknesses.

In some implementations, one or more second sidewalls of second component 204 may form a second enclosed volume of second component 204. By way of non-limiting example, the one or more second sidewalls of second component 204 may form a hollow, or substantially hollow, structure having the second shape of second component 204. In some implementations, the second enclosed volume of second component 204 may be fluidly sealed from an environment surrounding second component 204.

In some implementations, the second enclosed volume formed by the one or more second sidewalls of second component 204 may be at least partially filled with a cooling media and/or other substances. In some implementations, at least one of the one or more second sidewalls of second component 204 may include a second fluidly sealable fill port (not shown in FIG. 1) and/or other components. The second fluidly sealable fill port may provide access to the second enclosed volume of second component 204 to facilitate introducing a desired amount of cooling media to and/or removing a desired amount of cooling media from the second enclosed volume. By way of non-limiting example, the second fluidly sealable fill port may comprise one or more of an aperture communicating through a sidewall of second component 204, a plug and/or other components configured to removably fluidly seal the aperture, and/or other components. In some implementations, a second fluidly sealable fill port may be permanently sealed off once a desired amount of cooling media and/or other substances is provided in the second enclosed volume.

In some implementations, second component 204 may comprise one or more second recessed wells disposed in at least one of the one or more second sidewalls, and/or other components. Individual second recessed wells may be configured to receive at least part of individual containers for biologic products. Individual second recessed wells may include one or more of an open end, a closed end opposite the open end, one or more second well sidewalls running between the open end to the close end, and/or other components. Individual recessed wells of second component 204 may be sized in accordance with given biologic product containers that may be transported. For example, individual recessed wells may be sized in accordance with known geometries of biologic product containers. By way of non-limiting example, individual recessed wells may have a depth in the range of 10 to 100 millimeters and/or other ranges. By way of non-limiting example, a given recessed well of second component 202 may have a depth of 30 millimeters and/or other depth. Individual recessed wells of second component 204 may have a width in the range of 10 to 50 millimeters and/or other ranges. By way of non-limiting example, a given recessed well of second component 204 may have a width of 17 millimeters and/or other width.

In some implementations, an open end of a given second recessed well may be disposed at or near a plane of at least one second sidewall of second component 204 where the wells may be disposed. For example, an open end of a second recessed well may be flush with the at least one second sidewall of second component 204.

In some implementations, a given second recessed well of second component 204 may extend into the second enclosed volume of second component 204. A closed end and/or at least part of a given second well sidewall may come into contact with cooling media that may be disposed within the second enclosed volume. A contact of the given second recessed well with cooling media may facilitate heat transfer between the cooling media and a given container for biologic product that may be at least partially secured within the given second recessed well. For example, at least part of a container may contact at least part of a second well sidewall of a second recessed well, while the second recessed well may be in contact with cooling media within the second enclosed volume of second component 204. The various contacts may facilitate heat transfer between cooling media, a second recessed well, and a container that may be at least partially secured within the second recessed well. Heat transfer between cooling media, a recessed well, and a container may be accomplished in other ways.

In some implementations, first component 202, second component 204, and/or other components of containment apparatus 200 may be configured to cooperatively engage in a closed position of containment apparatus 200. In some implementations, the closed position may correspond to at least one of the one or more sidewalls of first component 202 and at least one of the one or more second sidewalls of second component 204 being in contact. By way of non-limiting example, a given sidewall of first component 202 where one or more recessed wells may be disposed may contact a given second sidewall of second component 204 where one or more second recessed wells may be disposed, to form the closed position of containment apparatus 200. Removing first component 202 from contact with second component 204 may form an open position of containment apparatus 200. The open position may allow a user to remove containers from their respective securement within a recessed well.

In some implementations, the one or more recessed wells of first component 202 and the one or more second recessed wells of second component 204 may be disposed and/or arranged at corresponding positions and/or orientations. By way of non-limiting example, an individual recessed well of first component 202 may correspond to an individual second recessed well of second component 204. In some implementations, individual recessed wells of first component 202 may be configured to substantially align with corresponding individual second recessed wells of second component 204 in the closed position of containment apparatus 200. The closed position of containment apparatus 200 may facilitate a securement of the one or more containers for biologic products by containment apparatus 200. For example, individual containers may be sandwiched between first component 202 and second component 204 via securement within corresponding recessed wells and second recessed wells.

By way of non-limiting example, a given recessed well of first component 202 may be configured to secure at least part of a given container. In the closed position of containment apparatus 200, a corresponding second recessed well of second component 204 may be configured to secure the remaining part of the given container.

In some implementations, first component 202 and second component 204 of containment apparatus 200 may comprise separate and discrete objects. An open position of containment apparatus 200 may correspond to a complete physical separation of first component 202 from second component 204. In some implementations, first component 202 and second component 204 may be rotationally engaged about a rotational engagement mechanism and/or other engagement mechanism. By way of non-limiting example, containment apparatus 200 may be formed such that first component 202 and second component 204 comprise individual halves of containment apparatus 200. The first component 202 and/or second component 204 may comprise halves of containment apparatus 200 that may be similar to a clamshell-type container and/or other types of containers. For example, first component 202 and second component 204 may be attached by a rotational engagement mechanism comprising one or more of a mechanical hinge, a living hinge, and/or other rotational engagement mechanism.

In some implementations, the closed position of containment apparatus 200 may be facilitated by a registration component of first component 202, a second registration component of second component 204, and/or other components of containment apparatus 200. In some implementations, the registration component and/or second registration component may be configured to facilitate a position and/or orientation registration of first component 202 with respect to second component 204. The position and/or orientation registration may be in accordance with the cooperative engagement of first component 202 with second component 204 to achieve the closed position of containment apparatus 200. By way of non-limiting example, a position and/or orientation registration of first component 202 with respect to second component 204 may facilitate properly aligning respective recessed wells of first component 202 with corresponding second recessed wells of second component 204 of containment apparatus 200.

In some implementations, the second registration component of second component 204 may be complementary to the registration component of first component 202. By way of non-limiting example, the registration component may comprise a protrusion and/or other structures. The second registration component may comprise a cavity and/or other structures. By way of non-limiting example, the cavity may be configured to receive the protrusion in a predetermined position and/or orientation of the first component 202 with respect to the second component 204. By way of non-limiting example, the registration component and second registration component may comprise a complementary tongue and groove pair and/or other structures.

It is noted that the above example of a cavity/protrusion and/or tongue/grove pair implementations for the registration component and second registration component, respectively, is for illustrative purposes only and is not intended to be limiting. For example, in some implementations, the registration component and second registration component may comprise one or more of opposing magnets, and/or other structures configured to facilitate a position and/or orientation registration of first component 202 with respect to second component 204.

In some implementations, securement of the one or more containers within containment apparatus 200 may correspond to one or more of physical isolation of individual ones and/or groups of the one or more containers from an environment surrounding containment apparatus 200, thermal isolation of individual ones and/or groups of the one or more containers from the environment surrounding containment apparatus 200, impact protection for individual ones and/or groups of the one or more containers against forces exerted on containment apparatus 200 from an environment surrounding containment apparatus 200, and/or other types of securement.

In some implementations, sleeve 300 may comprise one or more insulated sidewalls, one or more sleeve registration components, and/or other components. The one or more insulated sidewalls of sleeve 300 may form a shape of sleeve 300. The shape may comprise one or more of a cube, a cuboid, a cylinder, and/or other shapes. The sleeve 300 may have at least one open end. An open end may provide access to an open interior volume of sleeve 300. The sleeve 300 may be configured to at least partially encompass containment apparatus 200 when in the closed position, forming an as-used position of sleeve 300 and containment apparatus 200. The sleeve 300 may be configured to at least partially encompass the containment apparatus 200 by positioning containment apparatus 200 within the open interior volume via the at least one open end of sleeve 300. The containment apparatus 200 may be at least partially secured by sleeve 300 by virtue of the open end of sleeve 300 remaining open in the as-used position.

In some implementations, individual insulated sidewalls of sleeve 300 may comprise one or more of an inner layer that may be adjacent to the open interior volume of sleeve 300, an outer layer that may be adjacent an ambient environment of sleeve 300, and/or other components. In some implementations, the outer later, inner layer, and/or other parts of sleeve 300 may form respective third enclosed volumes of sleeve 300. In some implementations, individual third enclosed volumes of individual sidewalls of the sleeve 300 may be fluidly sealed from an environment surrounding sleeve 300. In some implementations, individual third enclosed volumes may be at least partially filled with cooling media.

In some implementations, positioning containment apparatus 200 within the open interior volume of sleeve 300 may be facilitated by the sleeve registration component of sleeve 300 and a complementary sleeve registration component disposed on one or both of first component 202 and/or second component 204. In some implementations, a complementary sleeve registration component of one or both of first component 202 and/or second component 204, and the complementary sleeve registration component of sleeve 300, may be configured to facilitate a position and/or orientation registration of containment apparatus 200 with respect to sleeve 300 to achieve the as-used position of sleeve 300 and containment apparatus 200.

In some implementations, a complementary sleeve registration component of first component 202 and/or second component 204 may comprise a protrusion and/or other structures. The sleeve registration component of sleeve 300 may comprise a channel and/or other structure. The channel may be configured to receive the protrusion. In some implementations, the sleeve registration component of sleeve 300 may be configured to lock the sleeve 300 and containment apparatus 200 in the as used position. By way of non-limiting example, the channel may include a locking portion that may be configured to lock a protrusion of the containment apparatus 200 within the channel.

It is noted that the above example of a channel/protrusion pair implementations for the sleeve registration components is for illustrative purposes only and is not intended to be limiting. For example, in some implementations, the sleeve registration components may comprise one or more of opposing magnets, and/or other structures configured to facilitate a position and/or orientation registration of first component 202 with respect to second component 204 and/or a locking of the containment apparatus 200 and sleeve 300 in the as-used position.

In some implementations, positioning of containment apparatus 200 within sleeve 300 in the as-used position may facilitate securement of containment apparatus 200 by sleeve 300. Securement of containment apparatus 200 by sleeve 300 may correspond to one or more of physical isolation of containment apparatus 200 from an environment surrounding sleeve 300, thermal isolation of the containment apparatus 200 from the environment surrounding sleeve 300, impact protection for containment apparatus 200 against forces exerted on sleeve 300 from an environment surrounding sleeve 300, and/or other types of securement.

By way of non-limiting example, in some implementations, containment apparatus 200 may be cooled to a first temperature such that the cooling media disposed within first component 202 and/or second component 204 may stay at or around the first temperature for a period of time. The first temperature may be above freezing temperatures. Containment apparatus 200 may be configured to maintain a temperature of biologic products secured by containment apparatus 200 that may be below freezing temperatures for the biologic products. Sleeve 300 may be cooled to a second temperature. The cooling media disposed within sleeve 300 may stay at or around the second temperature for a period of time. The second temperature may be a temperature at which the cooling media may freeze. By encompassing containment apparatus 200 with sleeve 300, sleeve 300 may be configured to ensure the temperature of the containment apparatus 200 maintains, or substantially maintains, the first temperature (e.g., cool but not frozen).

Figure 2:
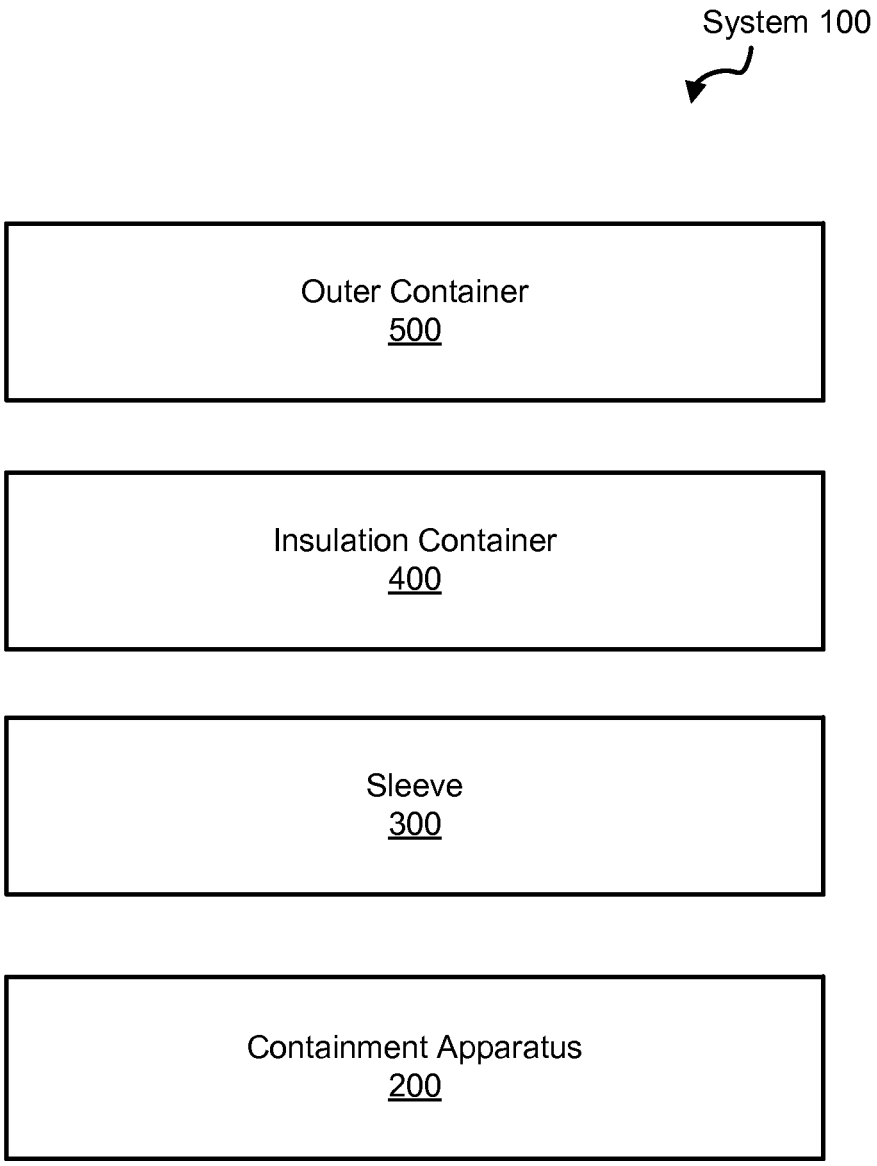
FIG. 2 illustrates another system configured for securing biologic products for transport in thermal isolation, in accordance with one or more implementations.

FIG. 2 illustrates another exemplary implementation of system 100 configured for securing biologic products for transport in thermal isolation. The system 100 may comprise one or more of containment apparatus 200, sleeve 300, an insulation container 400, an outer container 500, and/or other components.

In some implementations, insulation container 400 may comprise one or more sidewalls, at least one open end, an openable and/or removable cover of at least one open end, and/or other components. The one or more sidewalls of insulation container 400 may form a second open interior volume of insulation container 400. The insulation container 400 may be configured to receive containment apparatus 200 and/or sleeve 300 within the second open interior volume. In some implementations, insulation container 400 may be configured to secure containment apparatus 200 and sleeve 300 within the second open interior volume. Securement of containment apparatus 200 and sleeve 300 by insulation container 400 may correspond to one or more of physical isolation of containment apparatus 200 and sleeve 300 from an environment surrounding insulation container 400, thermal isolation of containment apparatus 200 and sleeve 300 from the environment surrounding insulation container 400, impact protection for containment apparatus 200 and sleeve 300 against forces exerted on insulation container 400 from an environment surrounding insulation container 400, and/or other types of securement. In some implementations insulation container 400 may comprise a foam box, and/or other structure. A foam box may comprise one or more of a polystyrene foam, and/or other insulating materials.

Figure 13:
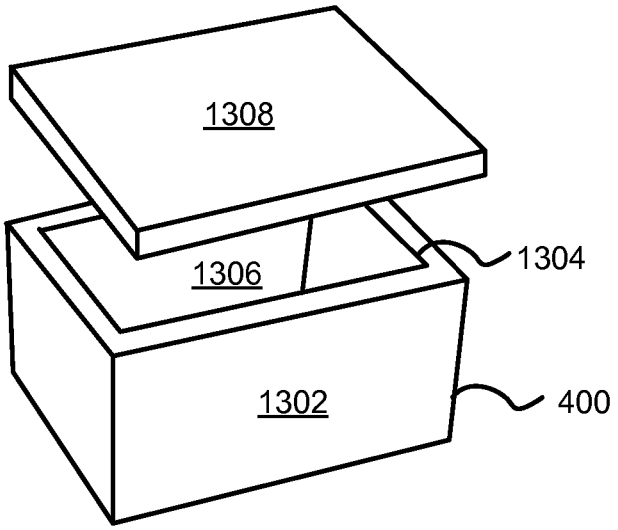
FIG. 13 illustrates an exemplary implementation of an insulation container of the system of FIG. 2.

By way of non-limiting illustration in FIG. 13, an exemplary implementation of insulation container 400 is shown. The insulation container 400 may comprise one or more sidewalls 1302, at least one open end 1304, an openable and/or removable cover 1308 (e.g., a lid and/or other components) of the at least one open end 1304, and/or other components. The one or more sidewalls 1302 of insulation container 400 may form the second open interior volume 1306 of insulation container 400. The insulation container 400 may be configured to receive containment apparatus 200 and/or sleeve 300 within second open interior volume 1306 when the containment apparatus 200 and sleeve 300 are in the as-used position. In some implementations, insulation container 400 may be configured to secure containment apparatus 200 and sleeve 300 within second open interior volume 1306.

Returning to FIG. 2, in some implementations, outer container 500 may comprise one or more sidewalls, at least one open end, an openable and/or removable cover of the at least one open end, and/or other components. The one or more sidewalls of outer container 500 may form a third open interior volume of outer container 500. The outer container 500 may be configured to receive insulation container 400 within the third open interior volume. In some implementations, outer container 500 may be configured to secure insulation container 400 within the third open interior volume. Securement of insulation container 400 by outer container 500 may correspond to one or more of physical isolation of insulation container 400 from an environment surrounding outer container 500, thermal isolation of insulation container 400 from the environment surrounding outer container 500, impact protection for insulation container 400 against forces exerted on outer container 500 from an environment surrounding outer container 500, and/or other types of securement. In some implementations, outer container 500 may comprise a shipping box, and/or other structure. A shipping box may comprise one or more of cardboard, and/or other materials.

Figure 14:
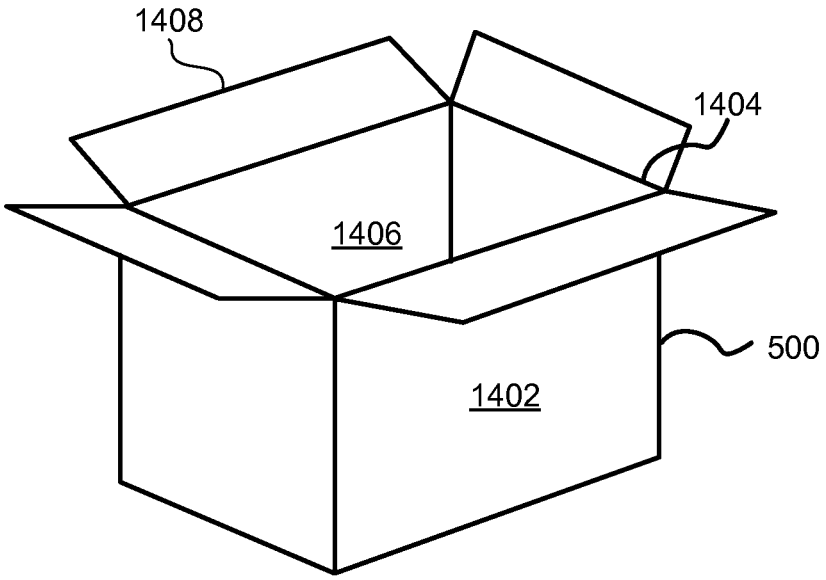
FIG. 14 illustrates an exemplary implementation of an outer container of the system of FIG. 2.

By way of non-limiting illustration in FIG. 14, an exemplar implementation of outer container 500 is shown. The outer container 500 may comprise one or more sidewalls 1402, at least one open end 1404, an openable and/or removable cover 1408 (e.g., closable flaps and/or other components) of the at least one open end 1404, and/or other components. The one or more sidewalls 1402 of outer container 500 may form a third open interior volume 1406 of outer container 500. The outer container 500 may be configured to receive insulation container 400 within third open interior volume 1406. In some implementations, outer container 500 may be configured to secure insulation container 400 within third open interior volume 1406.

Returning to FIG. 2, in some implementations, the provision of insulation container 400 within system 100 may help to insulate sleeve 300 and/or containment apparatus 200 such that cooling media within sleeve 300 and/or containment apparatus 200 may be not substantially change temperature during transport. System 100 may be desirable when transport of biologic products may take place in environments that may be substantially hotter than the desired transport temperatures of the biologic products.

Figure 3:
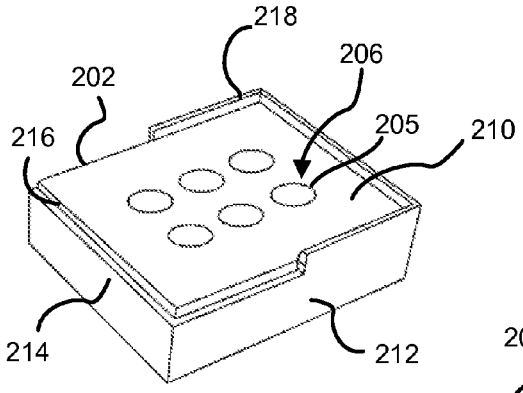
FIG. 3 illustrates a view of an exemplary implementation of a first component of a containment apparatus of the system of FIG. 1 and/or FIG. 2.
Figure 4:
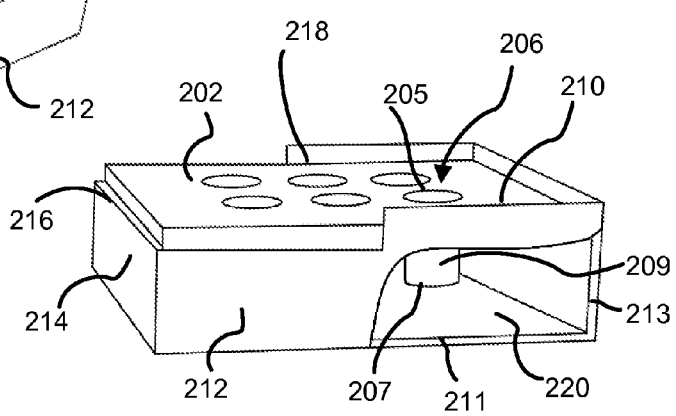
FIG. 4 illustrates a view of an exemplary implementation of a first component of a containment apparatus of the system of FIG. 1 and/or FIG. 2.

FIG. 3 and FIG. 4 illustrate views of an exemplary implementation of first component 202 of containment apparatus 200. It is noted that although FIG. 3 and FIG. 4 are directed to first component 202, in some implementations second component 204 may be configured similarly, or substantially similar, to the implementation of first component 202 as shown and described in FIG. 3 and FIG. 4. The first component 202 may comprise one or more sidewalls including one or more of a first sidewall 210, a second sidewall 211 (see, e.g., FIG. 4) opposite first sidewall 210, a third sidewall 212, a fourth sidewall 215 (see, e.g., FIG. 7) opposite third sidewall 212, a fifth sidewall 213 (see, e.g., FIG. 4), a sixth sidewall 214 opposite fifth sidewall 213, and/or other sidewalls. The one or more sidewalls of first component 202 may form a shape of first component 202. The shape may comprise, for example, a cuboid as substantially shown, and/or other shapes. The one or more sidewalls may individually have a predefined thickness. By way of non-limiting example, individual sidewalls may be in the range of one to five millimeters, and/or other ranges. By way of non-limiting example, individual sidewalls may be two millimeters thick, and/or other thicknesses.

In some implementations, one or more sidewalls of first component 202 may form an enclosed volume 220 (see, e.g., cut-away portion in FIG. 4) of the first component 202. By way of non-limiting example, the one or more sidewalls of first component 202 may form a hollow, or substantially hollow, structure having the shape of first component 202. In some implementations, enclosed volume 220 of first component 202 may be fluidly sealed from an environment surrounding first component 202. In some implementations, enclosed volume 220 formed by the one or more sidewalls of first component 202 may be at least partially filled with a cooling media and/or other substances.

The first component 202 may include one or more recessed wells disposed on first sidewall 210 and/or other sidewalls. The one or more recessed wells may include a first recessed well 206 and/or other recessed wells. The first recessed well 206 and/or other recessed wells may individually include an open end 205, a closed end 207 opposite the open end 205 (see, e.g., the cut-away portion of first component 202 in FIG. 4), one or more well sidewalls 209 communicating between open end 205 and closed end 207, and/or other components.

The first recessed well 206 and/or other recessed wells may be configured to receive at least part of individual containers for biologic products. In some implementations, open end 205 of first recessed well 206 may be disposed at or near a plane of first sidewall 210 as substantially shown in the figures. For example, open end 205 of first recessed well 206 and/or other recessed wells may be flush with first sidewall 210. The closed end 207 and/or at least part of well sidewall 209 may extend into enclosed volume 220 of first component 202 (see, e.g., cut-away portion in FIG. 4).

In some implementations, a closed position of containment apparatus 200 that includes implementations of first component 202 and/or second component 204 of FIG. 3 and FIG. 4, may be facilitated by a registration component of first component 202, a second registration component of second component 204, and/or other components of containment apparatus 200. In some implementations, a registration component of first component 204 may include a first portion 216, a second portion 218, and/or other portions. In some implementations, first portion 216 may include a cavity. Second portion 218 may include a protrusion. By way of non-limiting example, first portion 216 may comprise a groove that may extend at least partially around a perimeter edge of first sidewall 210. Second portion 218 may comprise a tongue that may extend at least partially around the perimeter edge of first sidewall 210. The registration component (e.g., first portion 216, second portion 218, and/or other portions) of first component 202 may be configured to cooperatively engage with corresponding complementary portions of the second registration component of second component 204 (see, e.g., FIG. 7).

Figure 7:
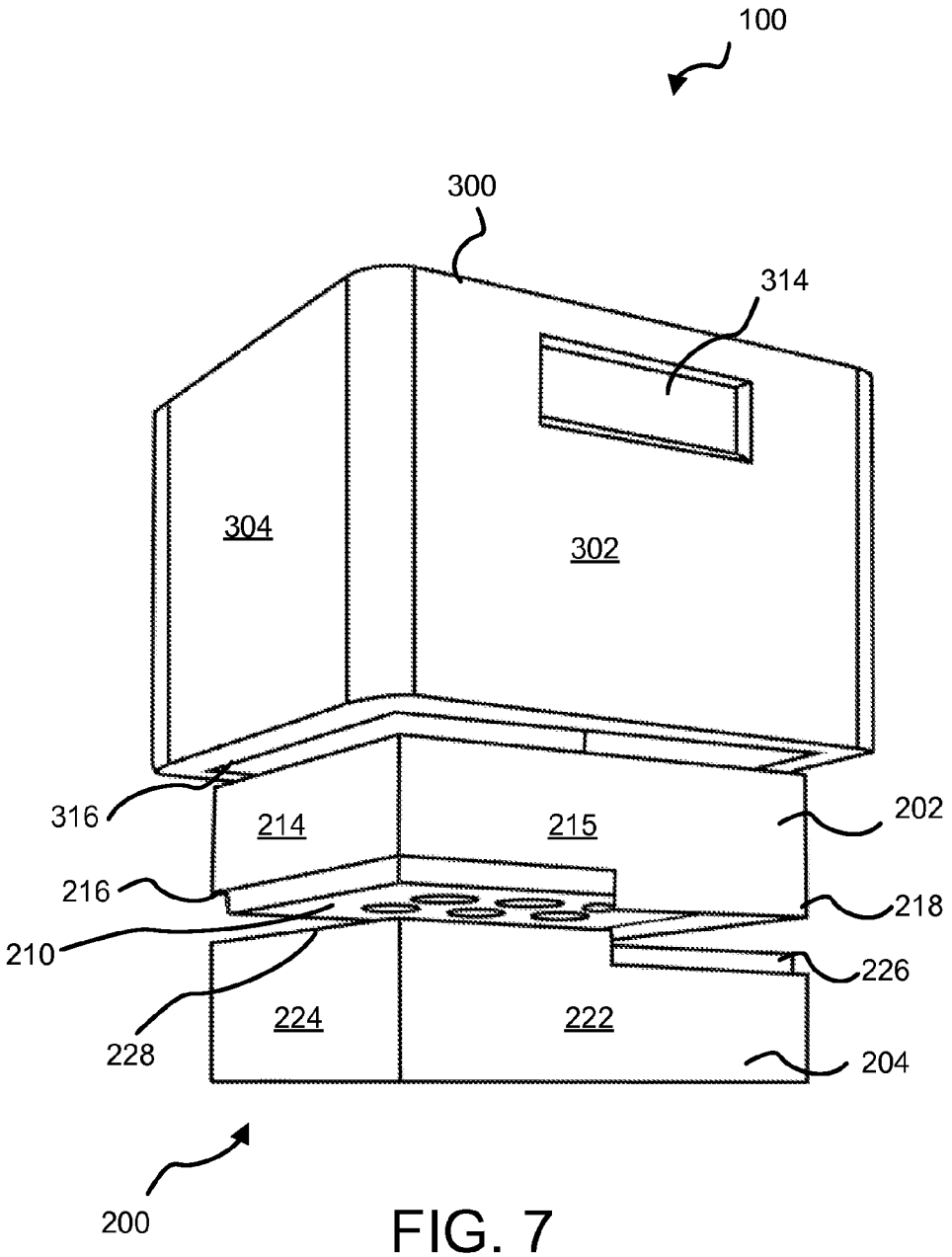
FIG. 7 illustrates an exemplary implementation of a system configured for securing biologic products for transport in thermal isolation.

By way of non-limiting illustration in FIG. 7, containment apparatus 200 including first component 202 and second component 204 configured in accordance with FIG. 3 and FIG. 4, are shown in a position and/or orientation to facilitate achieving the closed position of containment apparatus 200. The second component 204 may include one or more sidewalls including one or more of a first sidewall (not shown in FIG. 7), a second sidewall (not shown in FIG. 7) opposite the first sidewall, a third sidewall (not shown in FIG. 7), a fourth sidewall 222 opposite the third sidewall, a fifth sidewall 224, a sixth sidewall (not shown in FIG. 7) opposite fifth sidewall 224, and/or other sidewalls.

The second component 204 may include a complementary first portion 226 of a second registration component, a complementary second portion 228 of the second registration component, and/or other components. The complementary second portion 228 of the second registration component of second component 204 may be configured to cooperatively engage with first portion 216 of the registration component of first component 202. The complementary first portion 226 of the second registration component of second component 204 may be configured to cooperatively engage with the second portion 218 of the registration component of first component 202. The registration component and/or second registration component may facilitate a position and/or orientation registration of first component 202 with respect to second component 204 to achieve the closed position. It is noted that the closed position may be achieved when first sidewall 210 of first component 202 comes into contact with a corresponding first sidewall of second component 204 (e.g., the first sidewall of second component 204 being a sidewall of second component 204 substantially facing first sidewall 210 of first component 202 in the orientation shown in FIG. 7).

Figure 5:
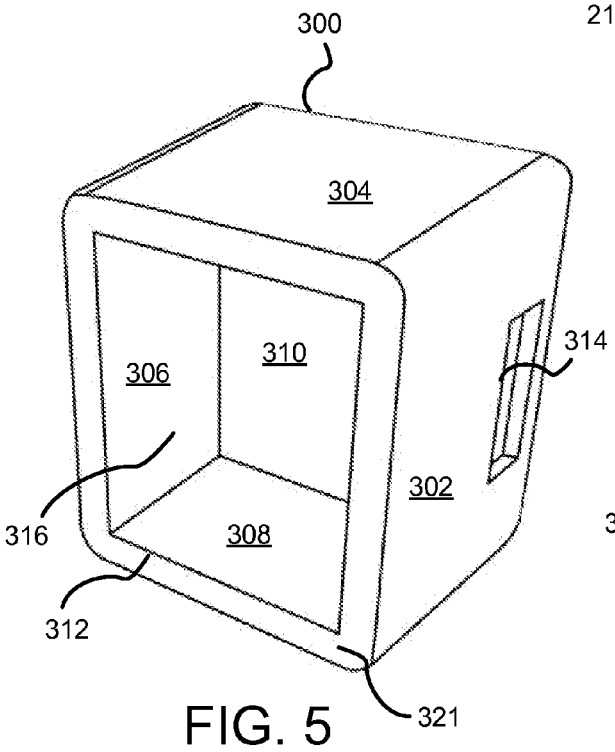
FIG. 5 illustrates a view of an exemplary implementation of a sleeve of the system of FIG. 1 and/or FIG. 2.

FIG. 5 illustrates an exemplary implementation of sleeve 300. In some implementations, sleeve 300 may comprise one or more insulated sidewalls including one or more of a first sidewall 302, a second sidewall 306 opposite the first sidewall 302, a third sidewall 304, a fourth sidewall 308 opposite third sidewall 304, a fifth sidewall 310, an end wall 321, and/or other sidewalls. The one or more insulated sidewalls of sleeve 300 may form a shape of sleeve 300. The shape may comprise, for example, a cuboid as substantially shown in the figure, and/or other shapes. The sleeve 300 may have at least one open end 312. The open end 312 may provide access to an open interior volume 316 of sleeve 300. The sleeve 300 may be configured to at least partially encompass containment apparatus 200 when in the closed position, forming an as-used position of the sleeve 300 and containment apparatus 200. The sleeve 300 may be configured to at least partially encompass containment apparatus 200 by positioning containment apparatus 200 within open interior volume 316 via the at least one open end 312 of sleeve 300.

Figure 6:
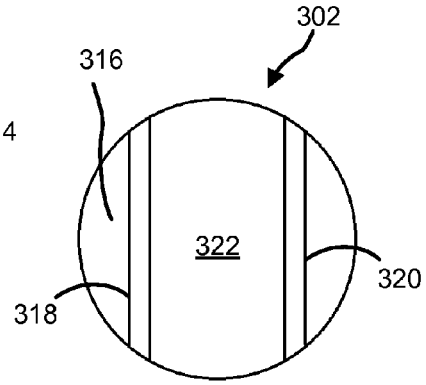
FIG. 6 illustrates a cross sectional view of an exemplary implementation of a sidewall of the sleeve of FIG. 5.

FIG. 6 illustrates a cross-sectional view of an exemplary implementation of first sidewall 302 of sleeve 300 of FIG. 5. Individual insulated sidewalls of sleeve 300 may comprise one or more of an inner layer that may be adjacent to the open interior volume of sleeve 300, an outer layer that may be adjacent an ambient environment of sleeve 300, and/or other components. The inner and outer layers may form respective third enclosed volumes. In some implementations, individual third enclosed volumes of individual sidewalls of the sleeve may be fluidly sealed from an environment surrounding sleeve 300. In some implementations, individual third enclosed volumes may be at least partially filled with cooling media. By way of non-limiting example, first sidewall 302 may include an inner layer 318 that may be adjacent to the open interior volume 316 of sleeve 300, an outer layer 320 that may be adjacent an ambient environment of sleeve 300, and/or other components. In some implementations, outer layer 320, inner layer 318, end wall 321, and/or other parts of sleeve 300 may form a third enclosed volume 322 of first sidewall 302. In some implementations, third enclosed volume 322 of first sidewall 302 may be fluidly sealed from an environment surrounding sleeve 300. In some implementations, third enclosed volume 322 may be at least partially filled with cooling media. In some implementations, sleeve 300 may include one or more handles 314.

Returning to FIG. 7, an exemplary implementation of system 100 configured for securing biologic products for transport in thermal isolation is shown. Sleeve 300 is shown in a position and/or orientation that may facilitate achieving the as-used position of sleeve 300 and containment apparatus 200 to secure containment apparatus 200 within open interior volume 316 of sleeve 300.

Figure 8:
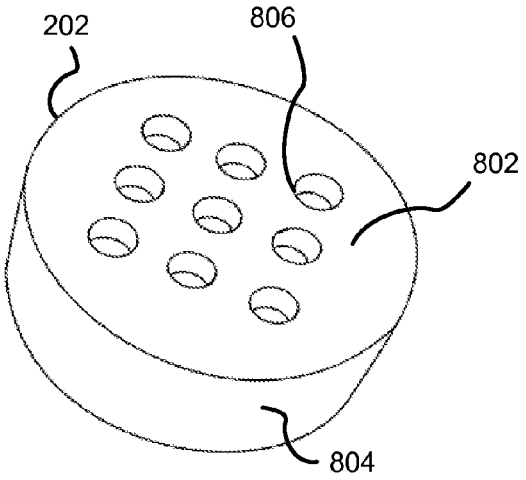
FIG. 8 illustrates an exemplary implementation of a first component of a containment apparatus of the system of FIG. 1 and/or FIG. 2.

FIG. 8 illustrates a view of another exemplary implementation of first component 202 of containment apparatus 200 of the system 100 of FIG. 1 and/or FIG. 2. The first component 202 may comprise one or more sidewalls including one or more of a first sidewall 802, a second sidewall (not shown in FIG. 8) opposite first sidewall 802, a third sidewall 804, and/or other sidewalls. The one or more sidewalls of first component 202 may form a shape of first component 202. The shape may comprise, for example, a cylinder as substantially shown, and/or other shapes. The one or more sidewalls may individually have a predefined thickness. By way of non-limiting example, individual sidewalls may be in the range of one to five millimeters, and/or other range. By way of non-limiting example, individual sidewalls may be two millimeters thick, and/or other thicknesses.

In some implementations, one or more sidewalls of first component 202 may form an enclosed volume of first component 202. By way of non-limiting example, the one or more sidewalls of first component 202 may form a hollow, or substantially hollow, structure having the shape of first component 202. In some implementations, the enclosed volume of first component 202 may be fluidly sealed from an environment surrounding first component 202.

The first component 202 may include one or more recessed wells disposed on first sidewall 802 and/or other sidewalls. The one or more recessed wells may include a first recessed well 806 and/or other recessed wells. The first recessed well 806 and/or other recessed wells may individually include an open end, a closed end opposite the open end, one or more well sidewalls communicating between the open end and the closed end, and/or other components. For example, first recessed well 806 may be formed similar to or substantially similar to the first recessed well 206 in FIG. 4.

Figure 9:
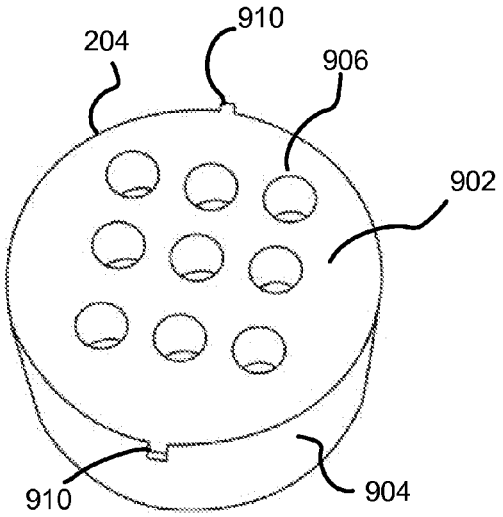
FIG. 9 illustrates an exemplary implementation of a second component of a containment apparatus of the system of FIG. 1 and/or FIG. 2.

FIG. 9 illustrates a view of an exemplary implementation of second component 204 of containment apparatus 200 of system 100 of FIG. 1 and/or FIG. 2. The second component 204 may comprise one or more sidewalls including one or more of a first sidewall 902, a second sidewall (not shown in FIG. 8) opposite first sidewall 902, a third sidewall 904, and/or other sidewalls. The one or more sidewalls of second component 204 may form a shape of second component 204. The shape may comprise, for example, a cylinder as substantially shown, and/or other shapes. The one or more sidewalls may individually have a predefined thickness. By way of non-limiting example, individual sidewalls may be in the range of one to five millimeters, and/or other range. By way of non-limiting example, individual sidewalls may be two millimeters thick, and/or other thicknesses. In some implementations, second component 204 may include one or more sleeve registration components 910.

In some implementations, one or more sidewalls of second component 204 may form a second enclosed volume of second component 204. By way of non-limiting example, the one or more sidewalls of second component 204 may form a hollow, or substantially hollow, structure having the shape of second component 204. In some implementations, the second enclosed volume of second component 204 may be fluidly sealed from an environment surrounding second component 204.

The second component 204 may include one or more recessed wells disposed on first sidewall 902 and/or other sidewalls. The one or more recessed wells may include a second recessed well 906 and/or other recessed wells. The second recessed well 906 and/or other recessed wells may individually include an open end, a closed end opposite the open end, one or more well sidewalls running between the open end and the closed end, and/or other components.

Figure 10:
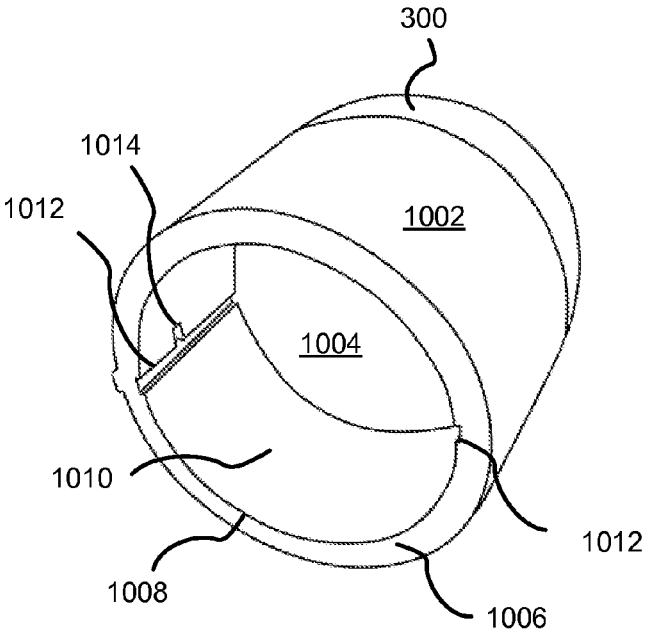
FIG. 10 illustrates an exemplary implementation of a sleeve of the system of FIG. 1 and/or FIG. 2.

FIG. 10 illustrates another exemplary implementation of sleeve 300. In some implementations, sleeve 300 may comprise one or more insulated sidewalls including one or more of a first sidewall 1002, a second sidewall 1004, an end wall 1006, and/or other sidewalls. The one or more insulated sidewalls of sleeve 300 may form a shape of sleeve 300. The shape may comprise, for example, a cylinder as substantially shown in the figure, and/or other shapes. The sleeve 300 may have at least one open end 1008. The open end 1008 may provide access to an open interior volume 1010 of the sleeve 300. The sleeve 300 may be configured to at least partially encompass containment apparatus 200 when in the closed position, forming an as-used position of sleeve 300 and containment apparatus 200. The sleeve 300 may be configured to at least partially encompass containment apparatus 200 by positioning containment apparatus 200 within open interior volume 1010 via the at least one open end 1008 of sleeve 300.

In some implementations, the positioning of containment apparatus 200 within open interior volume 1010 of sleeve 300 in the as-used position of sleeve 300 and containment apparatus 200 may be facilitated by a sleeve registration component 1012 of the sleeve 300 and the complementary sleeve registration components 910 disposed on second component 204 (see, e.g., FIG. 9). In some implementations, complementary sleeve registration components 910 of second component 204 and sleeve registration component 1012 of sleeve 300 may be configured to facilitate a position and/or orientation registration of containment apparatus 200 with respect to sleeve 300 when achieving the as-used position of sleeve 300 and containment apparatus 200. In some implementations, complementary sleeve registration components 910 of second component 204 and sleeve registration component 1012 of sleeve 300 may be configured to facilitate locking the sleeve 300 and containment apparatus 200 in the as-used position.

By way of non-limiting illustration, the sleeve registration components 910 of second component 204 may comprise one or more protrusions (see, e.g., FIG. 9). Sleeve registration component 1012 of sleeve 300 may comprise a channel that may be configured to receive the one or more protrusions. By way of non-limiting example, the protrusions may be configured to track within channel when positioning containment apparatus 200 within open interior volume 1004 of sleeve 400. In some implementations, sleeve registration component 1012 of sleeve 300 may include a locking portion 1014, and/or other portions. The locking portion 1014 may facilitate locking the containment apparatus 200 in the as-used position within sleeve 300. By way of non-limiting example, the locking portion 1014 may comprise a length of channel that extends substantially perpendicular to the main channel of sleeve registration component 1012. By way of non-limiting example, a user may insert containment apparatus 200 into open interior volume 1004 and turn sleeve 300 with respect to containment apparatus 200 to lock the protrusions of sleeve registration component 910 within locking portion 1014. Locking may be achieved in other ways.

Figure 11:
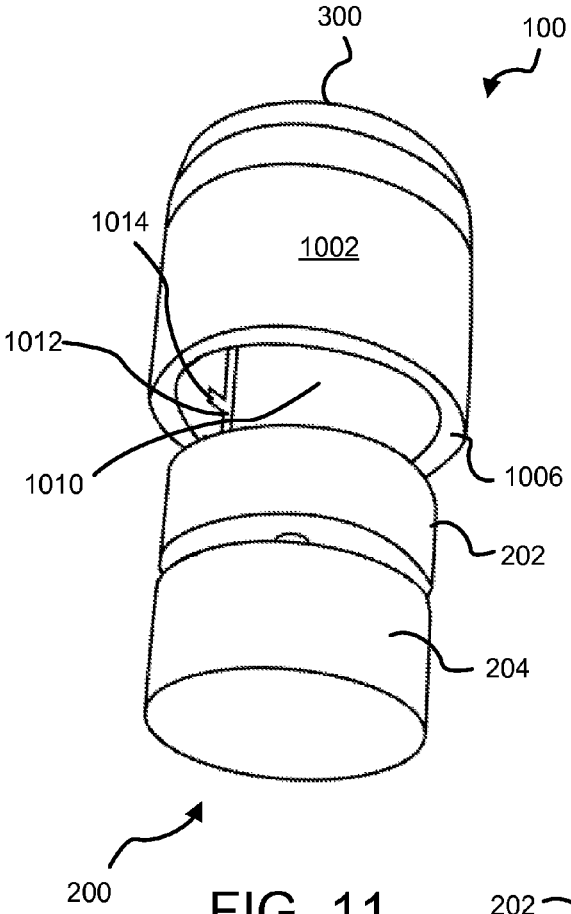
FIG. 11 illustrates an exemplary implementation of a system configured for securing biologic products for transport in thermal isolation.
Figure 12:
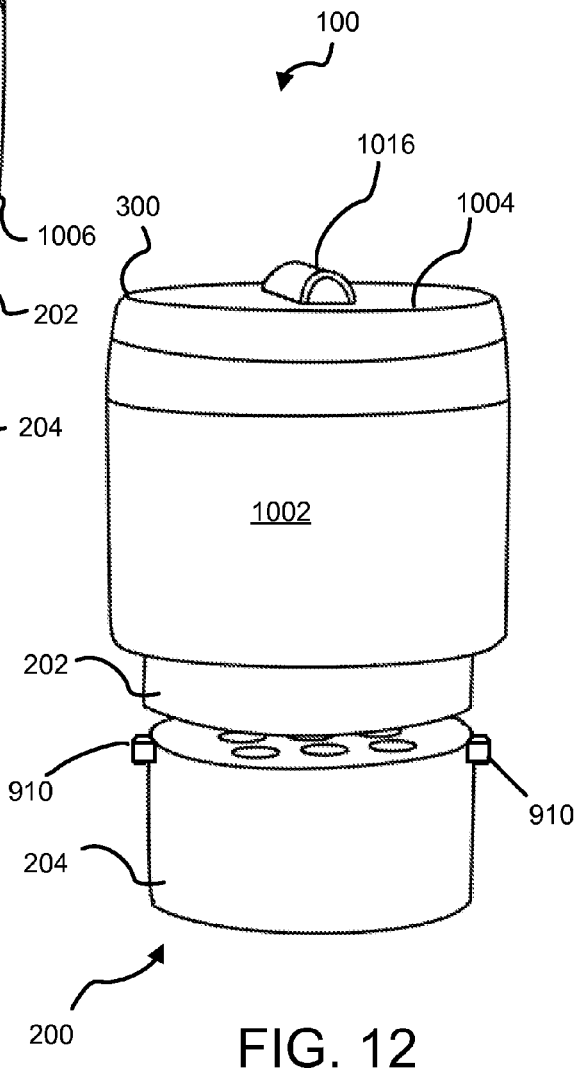
FIG. 12 illustrates another view of the system of FIG. 11.

FIG. 11 and FIG. 12 illustrate views of an exemplary implementation of system 100 configured for securing biologic products for transport in thermal isolation. The system 100 may include an implementation of containment apparatus 200 corresponding to first component 202 and second component 204 of FIG. 8 and FIG. 9, respectively; an implementation of sleeve 300 corresponding to sleeve 300 in FIG. 10; and/or other components. The first component 202 and second component 204 are shown positioned and/or orientated to facilitate achieving a closed position of containment apparatus 200. Sleeve 300 is shown in a position and/or orientation with respect to containment apparatus 200 that may facilitate achieving the as-used position of sleeve 300 and containment apparatus 200 to secure containment apparatus 200 within open interior volume 1010 of sleeve 300. In some implementations, sleeve 300 may comprise a handle 1016.

Figure 15:
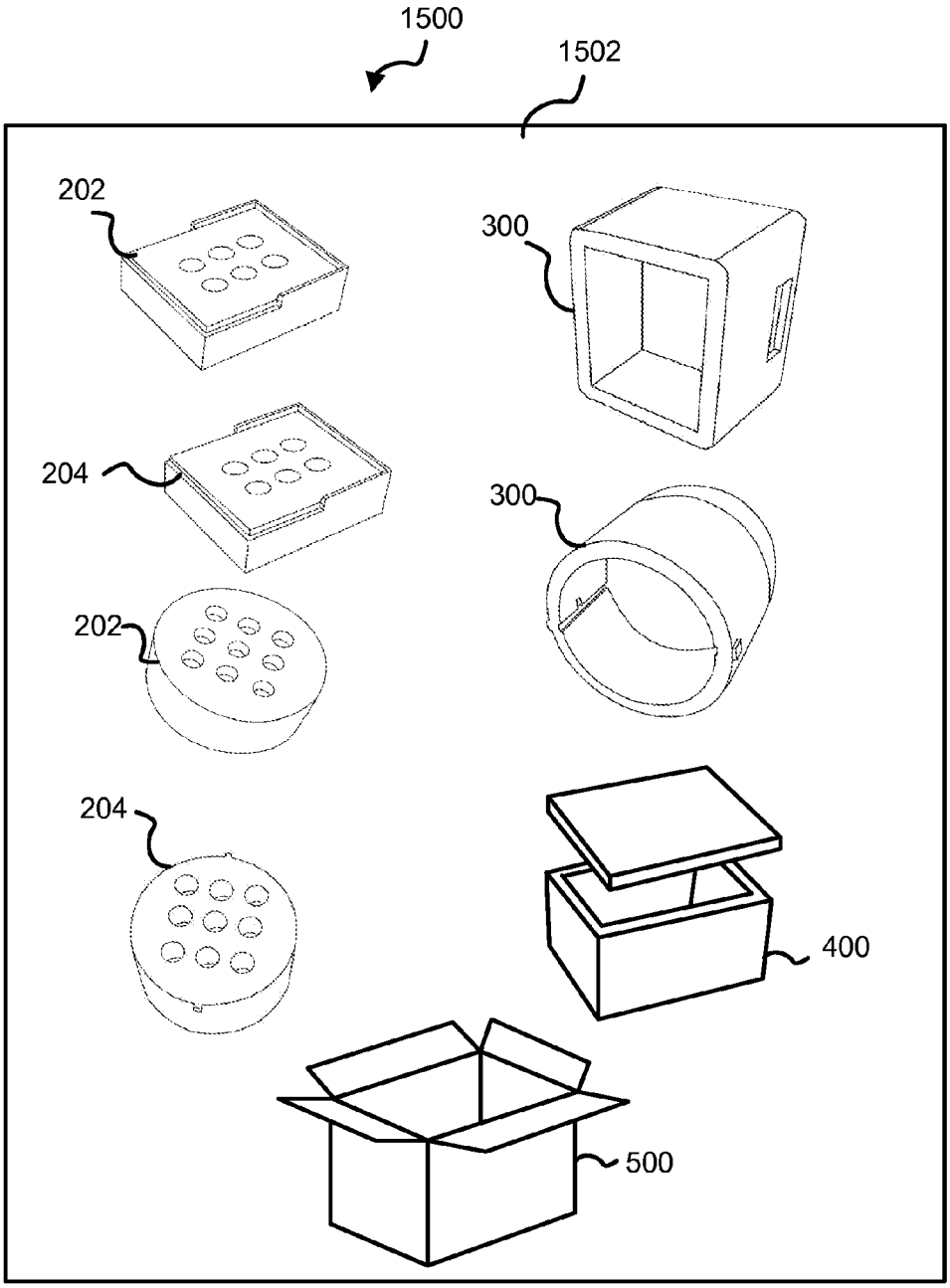
FIG. 15 illustrates an exemplary implementation of a kit of components configured for securing biologic products for transport in thermal isolation.

FIG. 15 illustrates an exemplary implementation of a kit 1500 of components configured for securing biologic products for transport in thermal isolation. Kit 1500 may include one or more implementations of first component 202 (e.g., first component 202 of FIG. 1, FIG. 3, FIG. 7, FIG. 8, FIG. 11, FIG. 12, and/or other implementations), one or more implementations of second component 204 (e.g., second component 204 of FIG. 1, FIG. 7, FIG. 9, FIG. 11, FIG. 12, and/or other implementations), one or more implementations of sleeve 300 (e.g., sleeve 300 of FIG. 1, FIG. 2, FIG. 5, FIG. 7, FIG. 10, FIG. 11, FIG. 12, and/or other implementations), one or more implementations of insulation container 400 (e.g., insulation container 400 of FIG. 2, FIG. 13, and/or other implementations), one or more implementations of outer container 500 (e.g., outer container 500 of FIG. 2, FIG. 14, and/or other implementations), and/or other components. In some implementations, kit 1500 may be configured such that one or more components of kit 1500 may be provided in a package 1502. For example, package 1502 may comprise one or more of a bag, a box, a container, and/or other packages.

While implementations are described herein in the context of securing containers for biologic products, this is not intended to be limiting, as these systems may be employed to secure other types of containers and/or objects.

Figure 16:
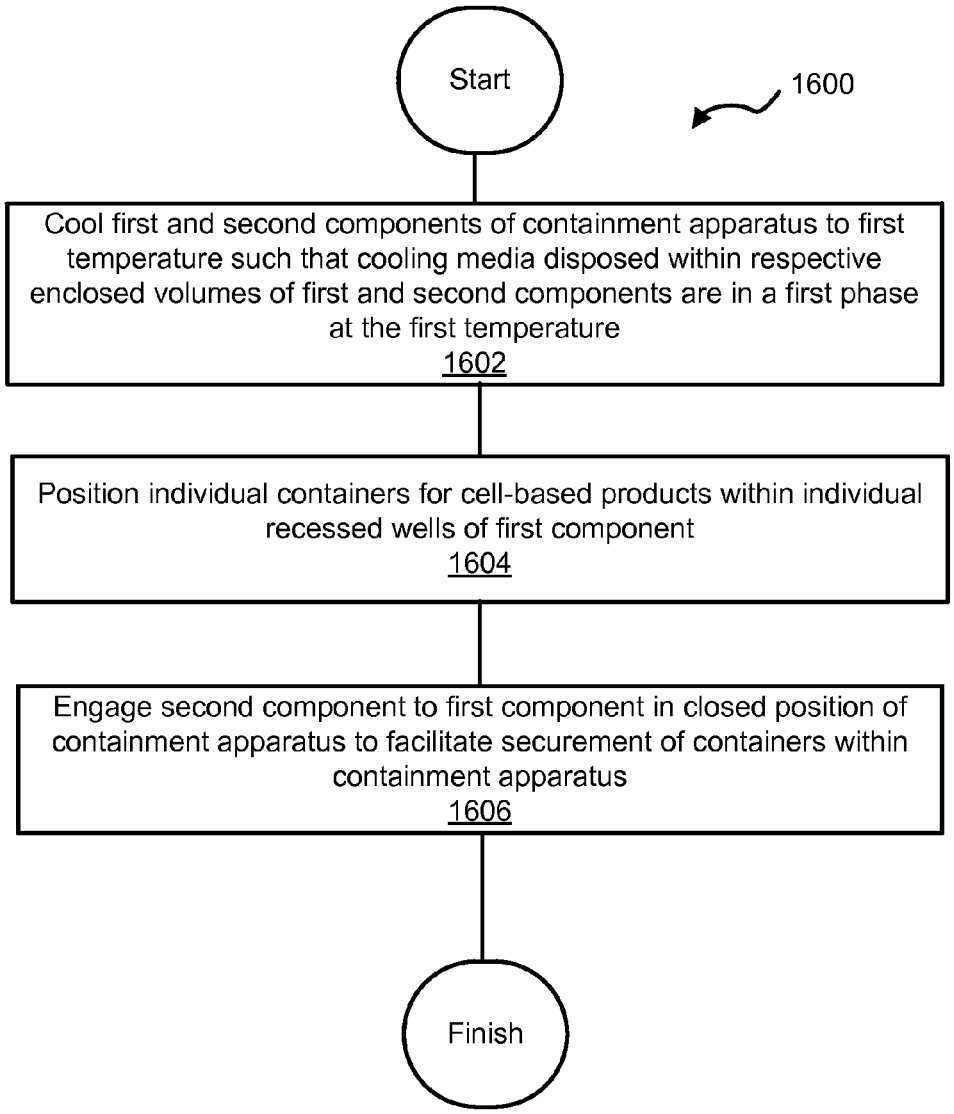
FIG. 16 illustrates an exemplary implementation of a method of securing biologic products for transport in thermal isolation.

FIG. 16 illustrates a method 1600 of securing biologic products for transport in thermal isolation, in accordance with one or more implementations. The operations of method 1600 presented below are intended to be illustrative. In some embodiments, method 1600 may be accomplished with one or more additional operations not described, and/or without one or more of the operations discussed. Additionally, the order in which the operations of method 1600 are illustrated in FIG. 16 and described below is not intended to be limiting.

In some embodiments, method 1600 may be performed by a user and implemented using one or more of a containment apparatus, a sleeve, a cooling device, and/or other components. By way of non-limiting example, the method may be implemented using a containment apparatus configured to secure one or more containers for biologic products for transport. The containment apparatus may comprise a first component, a second component, and/or other components. The first component, second component, and/or other components may be configured to cooperatively engage in a closed position of the containment apparatus. The closed position may facilitate a securement of the one or more containers by the containment apparatus. The first component may comprise one or more sidewalls forming an enclosed volume of the first component. The enclosed volume may be fluidly sealed from an environment surrounding the first component and at least partially filled with cooling media. The first component may further comprise one or more recessed wells that may be configured to receive at least part of individual containers. At least part of individual recessed wells may come into contact with the cooling media within the enclosed volume to facilitate heat transfer between the cooling media and individual containers disposed in individual recessed wells during securement of the one or more containers by the containment apparatus. The second component may comprise one or more second sidewalls forming a second enclosed volume of the second component. The second enclosed volume may be fluidly sealed from an environment surrounding the second component and at least partially filled with the cooling media. By way of non-limiting example, the method 1600 may be implemented using a containment apparatus the same or similar to containment apparatus 200 of FIG. 1, FIG. 2, FIG. 7, FIG. 11, FIG. 12, and/or other components; a sleeve the same or similar to sleeve 300 in FIG. 1, FIG. 2, FIG. 5, FIG. 7, FIG. 10, FIG. 11, FIG. 12, and/or other components; and/or other components. The cooling device may include one or more of a refrigerator, a freezer, an ice bath, and/or other cooling device.

At an operation 1602, the first component, second component, and/or other components of the containment apparatus may be cooled to a first temperature. The cooling media disposed within the enclosed volume of the first component and the second enclosed volume of the second component may be cooled to the first temperature. The cooling media may be in a first phase at the first temperature.

At an operation 1604, individual containers may be positioned within individual recessed wells of the first component.

At an operation 1606, the second component may be engaged to the first component in the closed position of the containment apparatus. The closed position of the containment apparatus may facilitate securement of the one or more containers within the containment apparatus.

Figure 17:
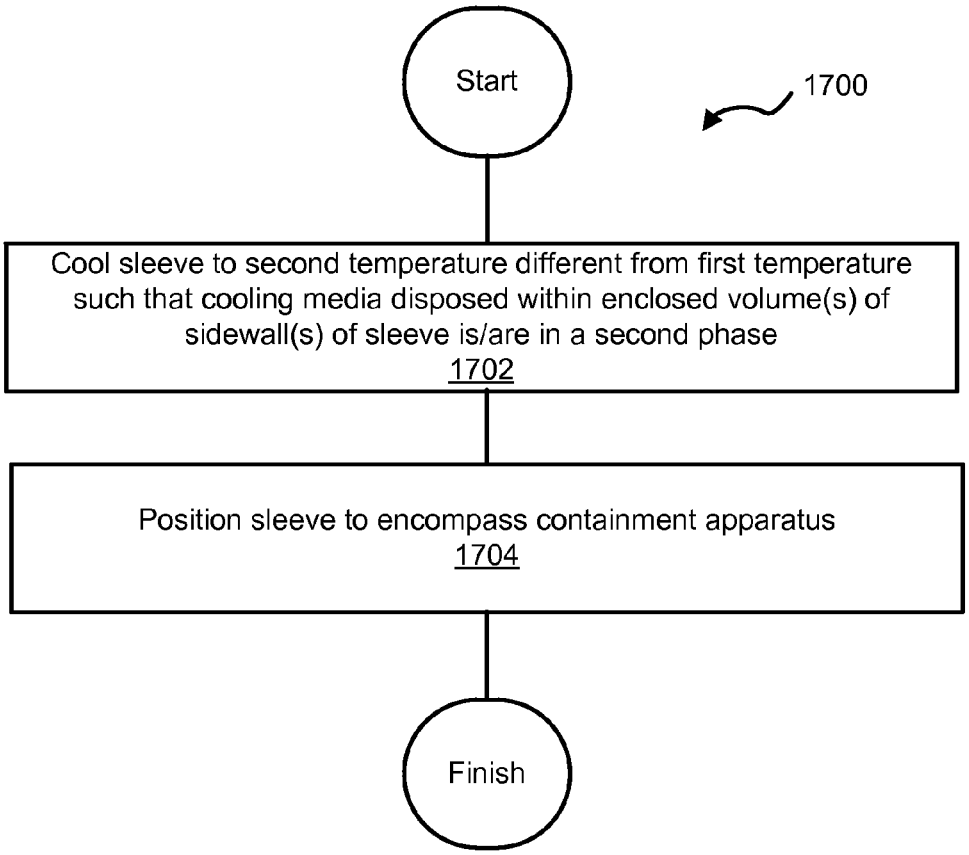
FIG. 17 illustrates another exemplary implementation of a method of securing biologic products for transport in thermal isolation.

FIG. 17 illustrates another method 1700 of securing biologic products for transport in thermal isolation, in accordance with one or more implementations. The operations of method 1700 presented below are intended to be illustrative. In some embodiments, method 1700 may be accomplished with one or more additional operations not described, and/or without one or more of the operations discussed. Additionally, the order in which the operations of method 1700 are illustrated in FIG. 17 and described below is not intended to be limiting. For example, one or more operations of method 1700 may comprise one or more operations performed in connection with method 1600 in FIG. 16.

In some embodiments, method 1700 may be performed by a user and implemented using one or more of a containment apparatus, a sleeve, a cooling device, and/or other components. By way of non-limiting example, the method may be implemented using a containment apparatus, a sleeve, a cooling device, and/or other components similar to components used for implementing method 1600 in FIG. 16.

At an operation 1702, the sleeve may be cooled to a second temperature. The second temperature may be different than the first temperature of operation 1602 in method 1600. Cooling media disposed within the third enclosed volume of the sleeve may be in a second phase when cooled to the second temperature.

At an operation 1704, the sleeve may be positioned to encompass the containment apparatus while the containment apparatus may be in the closed position.

Although the present technology has been described in detail for the purpose of illustration based on what are currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system configured for securing biologic products for transport in thermal isolation, the system comprising:

a containment apparatus configured to secure one or more containers including a first container for biologic products for transport, the containment apparatus comprising:

a first component comprising one or more sidewalls, the one or more sidewalls forming an enclosed volume of the first component, the enclosed volume being fluidly sealed from an environment surrounding the first component, the first component further comprising:

one or more recessed wells including a first recessed well, the first recessed well being configured to receive at least part of the first container, the first recessed well including:

an open end;

a closed end opposite the open end; and wherein the closed end extends into the enclosed volume of the first component; and a second component comprising one or more second sidewalls, the one or more second sidewalls forming a second enclosed volume of the second component, the second enclosed volume being fluidly sealed from an environment surrounding the second component;

wherein the first component and second component are configured to cooperatively engage in a closed position of the containment apparatus, the closed position facilitating a securement of the one or more containers by the containment apparatus;

wherein the enclosed volume of the first component and the second enclosed volume are each at least partially filled with a cooling media;

wherein at least part of the first recessed well comes into contact with the cooling media within the enclosed volume of the first component to facilitate heat transfer between the cooling media and the first container disposed in the first recessed well during securement of the containers by the containment apparatus;

wherein the second component further comprises one or more second recessed wells including a first second recessed well, the first second recessed well being configured to receive at least part of the first container, the first second recessed well including:

a second open end; and a second closed end opposite the second open end;

wherein the second closed end extends into the second enclosed volume of the second component; and wherein the closed position corresponds to the least one of the one or more sidewalls of the first component and the at least one of the one or more second sidewalls of the second component being in contact.

2. The system of claim 1, wherein the first recessed well of the one or more recessed wells of the first component corresponds to the first second recessed well of the one or more recessed wells of the second component, such that the first recessed well of the one or more recessed wells of the first component is disposed and arranged to substantially align with the first second recessed well of the one or more second recessed wells of the second component in the closed position of the containment apparatus.

3. A system configured for securing biologic products for transport in thermal isolation, the system comprising:

a containment apparatus configured to secure one or more containers including a first container for biologic products for transport, the containment apparatus comprising:

a first component comprising one or more sidewalls, the one or more sidewalls forming an enclosed volume of the first component, the enclosed volume being fluidly sealed from an environment surrounding the first component, the first component further comprising:

one or more recessed wells including a first recessed well, the first recessed well being configured to receive at least part of the first container, the first recessed well including:

an open end; and a closed end opposite the open end;

wherein the closed end extends into the enclosed volume of the first component; and a second component comprising one or more second sidewalls, the one or more second sidewalls forming a second enclosed volume of the second component, the second enclosed volume being fluidly sealed from an environment surrounding the second component;

wherein the first component and second component are configured to cooperatively engage in a closed position of the containment apparatus, the closed position facilitating a securement of the one or more containers by the containment apparatus;

wherein the enclosed volume of the first component and the second enclosed volume are each at least partially filled with a cooling media;

wherein at least part of the first recessed well comes into contact with the cooling media within the enclosed volume of the first component to facilitate heat transfer between the cooling media and the first container disposed in the first recessed well during securement of the containers by the containment apparatus;

wherein:

the first component further comprises a registration component; and the second component further comprises a complementary registration component;

wherein the registration component and complimentary registration component are configured to facilitate one or both of (1) a position or (2) an orientation registration of the first component with respect to the second component to facilitate the cooperative engagement of the first component with the second component in the closed position of the containment apparatus; and wherein the registration component comprises a protrusion and the complementary registration component comprises a cavity.

4. A system configured for securing biologic products for transport in thermal isolation, the system comprising:

a containment apparatus configured to secure one or more containers including a first container for biologic products for transport, the containment apparatus comprising:

a first component comprising one or more sidewalls, the one or more sidewalls forming an enclosed volume of the first component, the enclosed volume being fluidly sealed from an environment surrounding the first component, the first component further comprising:

one or more recessed wells including a first recessed well, the first recessed well being configured to receive at least part of the first container, the first recessed well including:

an open end; and a closed end opposite the open end;

wherein the closed end extends into the enclosed volume of the first component; and a second component comprising one or more second sidewalls, the one or more second sidewalls forming a second enclosed volume of the second component, the second enclosed volume being fluidly sealed from an environment surrounding the second component;

wherein the first component and second component are configured to cooperatively engage in a closed position of the containment apparatus, the closed position facilitating a securement of the one or more containers by the containment apparatus;

wherein the enclosed volume of the first component and the second enclosed volume are each at least partially filled with a cooling media; and wherein at least part of the first recessed well comes into contact with the cooling media within the enclosed volume of the first component to facilitate heat transfer between the cooling media and the first container disposed in the first recessed well during securement of the containers by the containment apparatus; and a sleeve, the sleeve being configured to at least partially encompass the containment apparatus when in the closed position, the sleeve comprising one or more insulated sidewalls including a first insulated sidewall, the first insulated sidewall having an outer layer and an inner layer forming the second enclosed volume between the inner and outer layers, the second enclosed volume being fluidly sealed from an environment surrounding the sleeve;

wherein the second enclosed volume is at least partially filled with the cooling media; and wherein:

one or both of the first component or second component include a sleeve registration component;

the sleeve includes a complimentary sleeve registration component; and the sleeve registration component and complimentary sleeve registration component are configured to facilitate one or both of (1) a position or (2) an orientation registration of the sleeve with respect to the containment apparatus to facilitate encompassing of the containment apparatus by the sleeve; and wherein the sleeve registration component comprises a protrusion and the complementary registration component comprises a cavity.

5. A system configured for securing biologic products for transport in thermal isolation, the system comprising:

a containment apparatus configured to secure one or more containers including a first container for biologic products for transport, the containment apparatus comprising:

a first component comprising one or more sidewalls, the one or more sidewalls forming an enclosed volume of the first component, the enclosed volume being fluidly sealed from an environment surrounding the first component, the first component further comprising:

one or more recessed wells including a first recessed well, the first recessed well being configured to receive at least part of the first container, the first recessed well including:

an open end; and a closed end opposite the open end;

wherein the closed end extends into the enclosed volume of the first component; and a second component comprising one or more second sidewalls, the one or more second sidewalls forming a second enclosed volume of the second component, the second enclosed volume being fluidly sealed from an environment surrounding the second component;

wherein the first component and second component are configured to cooperatively engage in a closed position of the containment apparatus, the closed position facilitating a securement of the one or more containers by the containment apparatus;

wherein the enclosed volume of the first component and the second enclosed volume are each at least partially filled with a cooling media;

wherein at least part of the first recessed well comes into contact with the cooling media within the enclosed volume of the first component to facilitate heat transfer between the cooling media and the first container disposed in the first recessed well during securement of the containers by the containment apparatus; and wherein the cooling media comprises a gel when the cooling media is in a first phase and a solid when the cooling media is in a second phase, wherein the change in phases is effectuated by a change in temperature of the cooling media.

6. A system configured for thermally isolating biologic products for transport, the system comprising:

a containment apparatus configured to secure one or more containers including a first container for biologic products for transport, the containment apparatus comprising:

a first component comprising one or more sidewalls, the one or more sidewalls forming an enclosed volume of the first component, the enclosed volume being fluidly sealed from an environment surrounding the first component, the first component further comprising:

one or more recessed wells including a first recessed well, the first recessed well being configured to receive at least part of the first container, the first recessed well including:

an open end; and a closed end opposite the open end;

wherein the closed end extends into the enclosed volume of the first component; and a second component comprising one or more second sidewalls, the one or more second sidewalls forming a second enclosed volume of the second component, the second enclosed volume being fluidly sealed from an environment surrounding the second component, the second component further comprising;

one or more second recessed wells including a first second recessed well, the first second recessed well being configured to receive at least part of the first container, the first second recessed wells including:

a second open end; and a second closed end opposite the second open end;

wherein the second closed end extends into the second enclosed volume of the second component;

wherein the first component and second component are configured to cooperatively engage in a closed position of the containment apparatus, the closed position facilitating a securement of the one or more containers by the containment apparatus;

wherein the enclosed volume of the first component and the second enclosed volume are each at least partially filled with a cooling media; and wherein at least part of the first recessed well comes into contact with the cooling media within the enclosed volume of the first component to facilitate heat transfer between the cooling media and the first container disposed in the first recessed well during securement of the containers by the containment apparatus;

a sleeve, the sleeve being configured to at least partially encompass the containment apparatus when in the closed position, the sleeve comprising one or more insulated sidewalls including a first insulated sidewall, the first insulated sidewall having an outer layer and an inner layer forming the second enclosed volume between the inner and outer layers, the second enclosed volume being fluidly sealed from an environment surrounding the sleeve;

wherein the second enclosed volume is at least partially filled with the cooling media; and an insulation container configured to receive the containment apparatus and sleeve when the containment apparatus is in the closed position and encompassed by the sleeve.

7. The system of claim 6, wherein the insulation container comprises a foam box.

8. A system configured for thermally isolating biologic products for transport, the system comprising:

a containment apparatus configured to secure one or more containers including a first container for biologic products for transport, the containment apparatus comprising:

a first component comprising one or more sidewalls, the one or more sidewalls forming an enclosed volume of the first component, the enclosed volume being fluidly sealed from an environment surrounding the first component, the first component further comprising:

one or more recessed wells including a first recessed well, the first recessed well being configured to receive at least part of the first container, the first recessed well including:

an open end; and a closed end opposite the open end;

wherein the closed end extends into the enclosed volume of the first component; and a second component comprising one or more second sidewalls, the one or more second sidewalls forming a second enclosed volume of the second component, the second enclosed volume being fluidly sealed from an environment surrounding the second component, the second component further comprising;

one or more second recessed wells including a first second recessed well, the first second recessed wells being configured to receive at least part of the first container, the first second recessed well including:

a second open end; and a second closed end opposite the second open end;

wherein the second closed end extends into the second enclosed volume of the second component;

wherein the first component and second component are configured to cooperatively engage in a closed position of the containment apparatus, the closed position facilitating a securement of the one or more containers by the containment apparatus;

wherein the enclosed volume of the first component and the second enclosed volume are each at least partially filled with a cooling media; and wherein at least part of the first recessed well comes into contact with the cooling media within the enclosed volume of the first component to facilitate heat transfer between the cooling media and the first container disposed in the first recessed well during securement of the containers by the containment apparatus;

a sleeve, the sleeve being configured to at least partially encompass the containment apparatus when in the closed position, the sleeve comprising one or more insulated sidewalls including a first insulated sidewall, the first insulated sidewall having an outer layer and an inner layer forming a second enclosed volume between the inner and outer layers, the second enclosed volume being fluidly sealed from an environment surrounding the sleeve;

wherein the second enclosed volume is at least partially filled with the cooling media; and an outer container configured to receive insulation.

9. The system of claim 7, wherein the outer container comprises a shipping box.

10. A method of securing biologic products for transport in thermal isolation, the method being implemented using a containment apparatus configured to secure one or more containers including a first container for biologic products for transport, wherein the containment apparatus comprises a first component and a second component configured to cooperatively engage in a closed position of the containment apparatus, the closed position facilitating a securement of the one or more containers by the containment apparatus, wherein the first component comprises one or more sidewalls forming a first enclosed volume of the first component, the first enclosed volume being fluidly sealed from an environment surrounding the first component and at least partially filled with cooling media, the first component further comprising one or more recessed wells including a first recessed well that are configured to receive at least part of the first container, and wherein the second component comprises one or more second sidewalls forming a second enclosed volume of the second component, the second enclosed volume being fluidly sealed from an environment surrounding the second component and at least partially filled with the cooling media, wherein at least part of the first recessed well comes into contact with the cooling media within the first enclosed volume to facilitate heat transfer between the cooling media and the first container disposed in the first recessed well during securement of the one or more containers by the containment apparatus, the method comprising:

cooling the first component and second component to a first temperature such that the cooling media disposed within the first enclosed volume and second enclosed volume is in a first phase at the first temperature;

positioning the first container within the first recessed well of the first component; and engaging the second component to the first component in the closed position of the containment apparatus to facilitate the securement of the one or more containers within the containment apparatus;

wherein the first temperature is in the range of 0 to 8 degrees Celsius.

11. The method of claim 10, being further implemented using a sleeve configured to at least partially encompass the containment apparatus when in the closed position, the sleeve comprising one or more insulated sidewalls including a first insulated sidewall, the first insulated sidewall having an outer layer and an inner layer forming a third enclosed volume between the inner and outer layers, the third enclosed volume being fluidly sealed from an environment surrounding the sleeve and at least partially filled with the cooling media, wherein the method further comprises:

cooling the sleeve to a second temperature, the second temperature being different than the first temperature such that the cooling media disposed within the third enclosed volume is in a second phase at the second temperature; and positioning the sleeve to encompass the containment apparatus being in the closed position.

12. The method of claim 10, wherein the second temperature is in the range of −30 to 0 degrees Celsius.

13. A method of securing biologic products for transport in thermal isolation, the method being implemented using a containment apparatus configured to secure one or more containers including a first container for biologic products for transport, wherein the containment apparatus comprises a first component and a second component configured to cooperatively engage in a closed position of the containment apparatus, the closed position facilitating a securement of the one or more containers by the containment apparatus, wherein the first component comprises one or more sidewalls forming a first enclosed volume of the first component, the first enclosed volume being fluidly sealed from an environment surrounding the first component and at least partially filled with cooling media, the first component further comprising one or more recessed wells including a first recessed well that are configured to receive at least part of the first container, and wherein the second component comprises one or more second sidewalls forming a second enclosed volume of the second component, the second enclosed volume being fluidly sealed from an environment surrounding the second component and at least partially filled with the cooling media, wherein at least part of the first recessed well comes into contact with the cooling media within the first enclosed volume to facilitate heat transfer between the cooling media and the first container disposed in the first recessed well during securement of the one or more containers by the containment apparatus, the method comprising:

cooling the first component and second component to a first temperature such that the cooling media disposed within the first enclosed volume and second enclosed volume is in a first phase at the first temperature;

positioning the first container within the first recessed well of the first component; and engaging the second component to the first component in the closed position of the containment apparatus to facilitate the securement of the one or more containers within the containment apparatus;

wherein the first phase of the cooling media is a gel.

* * * * *